United States Patent [19]

Mlenek

[11] Patent Number: 4,838,332

[45] Date of Patent: Jun. 13, 1989

[54] SWINGING SCREEN DOOR FOR SLIDING GLASS DOORS

[76] Inventor: Patrick L. Mlenek, 9800 Southridge Dr., Oklahoma City, Okla. 73159

[21] Appl. No.: 43,170

[22] Filed: Apr. 27, 1987

Related U.S. Application Data

[63] Continuation-in-part of Ser. No. 923,876, Oct. 28, 1986, abandoned.

[51] Int. Cl.[4] ..... E06B 9/01

[52] U.S. Cl. ..... 160/90; 160/113; 160/40; 160/369

[58] Field of Search ..... 160/89, 90, 91, 40, 160/43, 369, 371, 372, 374, 375, 381, 87, 117, 179, 113; 49/168, 177

[56] References Cited

U.S. PATENT DOCUMENTS

| | | | |
|---|---|---|---|
| 475,531 | 5/1892 | Anderson . | |
| 1,213,249 | 1/1917 | Phillips . | |
| 1,430,015 | 9/1922 | Icher . | |
| 1,462,806 | 7/1923 | Gibson . | |
| 1,681,534 | 8/1928 | Green . | |
| 2,279,572 | 4/1942 | Kann . | |
| 2,443,275 | 6/1948 | Scifres | 160/18 |
| 2,539,345 | 1/1951 | Creech | 189/7 |
| 2,702,414 | 2/1955 | Holden | 20/55 |
| 2,894,579 | 7/1959 | Rust et al. | 160/381 X |
| 3,047,912 | 8/1962 | Sobolewski | 20/16 |
| 3,120,033 | 4/1964 | Andres | 20/19 |
| 3,291,192 | 12/1966 | Jones, Jr. | 160/91 |
| 3,464,158 | 9/1969 | Greene | 49/168 |
| 3,654,733 | 4/1972 | Blackwell | 49/168 |
| 3,710,839 | 1/1973 | Andres | 160/91 X |
| 4,053,007 | 10/1977 | Griffith | 49/168 X |
| 4,408,416 | 10/1983 | Davlantes | 49/168 |
| 4,478,267 | 10/1984 | Smiley | 160/91 X |

*Primary Examiner*—Ramon S. Britts
*Assistant Examiner*—David Purol
*Attorney, Agent, or Firm*—Dunlap, Codding, Peterson & Lee

[57] ABSTRACT

A pivotally mounted secondary door, such as a screen door, for sliding doors, such as sliding glass "patio" doors. The secondary door swings inwardly and outwardly and preferably is provided with an automatic return. A system of seals is provided for preventing insects and such from entering around the edges of the secondary door and along the sides of the assembly. The assembly can be adjusted to accommodate sliding door frames of different internal vertical dimensions.

49 Claims, 9 Drawing Sheets

SWINGING SCREEN DOOR FOR SLIDING GLASS DOORS

This application is a continuation-in-part of application Ser. No. 923,876, filed Oct. 28, 1986, entitled "SCREEN DOOR".

FIELD OF THE INVENTION

The present invention relates to doors in general and to screen doors for sliding doors in particular.

SUMMARY OF THE INVENTION

The present invention comprises a secondary door assembly for a primary doorway which connects an inside and an outside and which is defined by a primary frame having two primary uprights, a primary header and a primary threshold. The primary doorway has at least one primary door which is slidably mounted within the primary frame so that when the sliding door is retracted a portion of the doorway is opened forming a primary opening. The secondary door assembly comprises a secondary frame which is receivable within the primary frame. The secondary frame defines a secondary doorway substantially coextensive with the primary opening. The secondary frame has a secondary header and two secondary uprights. The secondary header is receivable within the primary header. Each secondary upright is receivable adjacent a primary upright and also is adapted for free standing within the primary frame. The secondary door assembly further comprises means for securing the secondary frame to the primary frame so that the secondary doorway is parallel to the plane of the primary opening, a secondary door receivable within the secondary frame, and means for mounting the secondary door within the secondary frame so that the secondary door is supported for pivotation about a vertical axis from a closed position parrallel to the primary opening.

The present invention further comprises a screen door replacement kit for a sliding glass doorway which connects an inside and an outside. The doorway comprises a primary frame having a primary header, two primary uprights and a primary threshold. The doorway has at least two glass doors mounted on parallel planes within the primary frame, and at least one such door is slidably mounted so that when the sliding glass door is retracted, a portion of the doorway is opened to form a primary opening. The kit comprises a secondary frame which is receivable within the primary frame. The secondary frame defines a secondary doorway substantially coextensive with the primary opening. The secondary frame has a secondary header and two secondary uprights. The secondary header is receivable within the primary header. Each secondary upright is receivable adjacent a primary upright and also is adapted for free standing within the primary frame. The kit further comprises means for securing the secondary frame within the primary frame so that the secondary doorway is parallel to the plane of the primary opening, a screen door receivable within the secondary frame, and means for mounting the screen door within the secondary frame so that the screen door is supported for pivotation about a vertical axis from a closed position parallel to the primary opening.

The present invention further comprises a sliding glass door assembly for a doorway connecting an inside and an outside. This assembly comprises a frame receivable within the doorway, and the frame comprises a header, a threshold and two uprights. The sliding glass door assembly also comprises at least two solid doors mounted on parallel planes within the frame, at least one of the solid doors being slidably mounted so that upon retraction the doorway is at least partially opened to form a primary opening. The assembly also comprises a screen door comprising at least one panel support within the frame in a closed position to the primary opening. The screen door has dimensions which are subtantially coextensive with the primary opening and which permit the screen door to move through the primary opening. The assembly also includes means for mounting the screen door for pivotation about a vertical axis for movement in an inward and an outward direction from the closed position, and means for providing a seal between the inside and outside when the screen door is in closed position.

BRIEF DESCRIPTION OF THE DRAWINGS

FIG. 29 is a cross-sectional view taken along line 29 of FIG. 1 showing the relative positions of the secondary door assembly and the primary frame and primary doors.

FIG. 30 is a cross-sectional view taken along line 30 of FIG. 28 showing the relative positions of the screen door, the frame and the glass doors.

DETAILED DESCRIPTION OF THE PREFERRED EMBODIMENTS

Sliding glass doorways, often called "patio" doorways, have long been enjoyed by many in their homes and other buildings. Such doors provide a wide visual range and increased natural lighting. However, a disadvantage of sliding glass doors has always been the lack of a satisfactory screen door arrangement. Typically, sliding glass doors are equipped with a sliding screen door which is installed on a parellel track in the same frame as the sliding glass doors. Usually, these sliding screen doors are manually operated and do not return automatically to the closed position. Thus, they often are left open inadvertently allowing undesired entry of insects, air-borne matter, and the like. Another disadvantage of conventional sliding screen doors is that they frequently stick or become derailed from their sliding track. These and other problems have prevented full enjoyment of sliding glass doors.

The present invention eliminates these problems and permits full use and enjoyment of sliding glass doors. The screen door of the present invention is pivotally mounted and can be opened through the doorway into the inside as well as toward the outside. Further, the present screen door can be provided with a mechanism which automatically returns the screen door to a closed position after it has been opened in either direction. Also, a seal means is provided to prevent entry of insects and the like around the edges of the swinging screen door and along the side of the assembly when the sliding glass door is opened and the screen door is closed. The secondary door assembly of the present invention may be adjusted to fit the various internal vertical dimensions of commercially available sliding glass door frames.

Secondary Door Assembly

Figure 1:
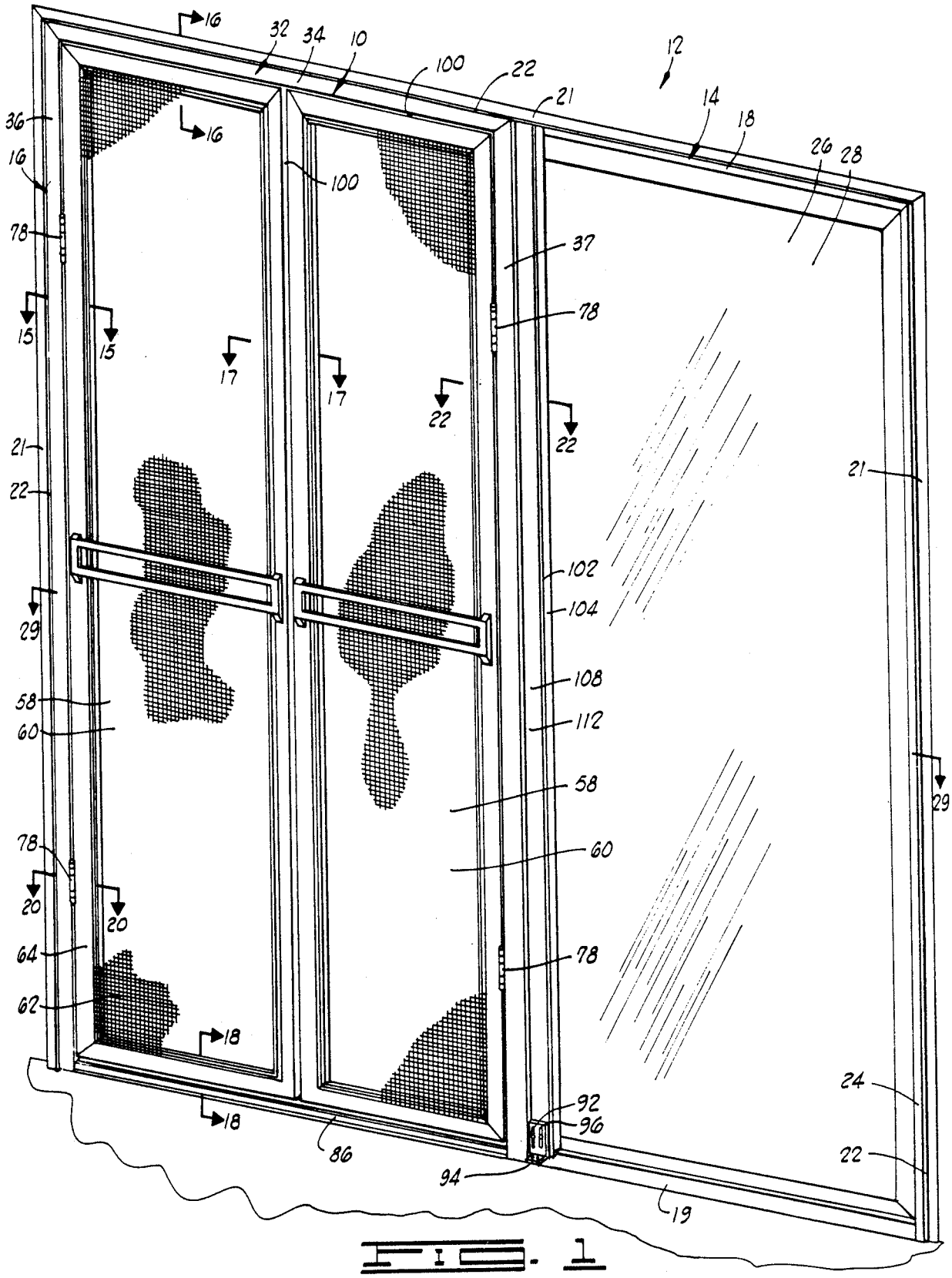
FIG. 1 is a perspective view of the secondary door assembly of the present invention shown installed in a sliding glass doorway. The embodiment shown comprises a screen door having two screen panels.

As shown in FIGS. 1 and 29, the present invention comprises a secondary assembly, designated generally by the reference numeral 10, for a primary doorway which connects an inside and an outside. As used herein, the terms "inside" and "outside" are used merely to distinguish the areas which the doorway connects. In most instances, "inside" and "outside" will be the inside and outside of a room, a dwelling or a building, such as where the doorway connects the inside of a home or building with the out-of-doors. However, the terms "inside" and "outside" are not so limited.

The primary doorway 12 is defined by a primary frame 14 comprising two primary uprights 16, a primary header 18, and a primary threshold 19. As shown in the Figures in most instances the primary frame 14 will be fixed to the studs 20 of the rough opening and provided with interior and exterior trim 21. It should be noted that complete frames for sliding glass doorways are commercially available.

While these vary in some design details, most such frames are provided with an exterior lip portion 22 which is usually L-shaped. This lip portion 22 extends about the outside of the primary frame as best shown in FIGS. 15, 16, 20 and 29. In most instances, the lip 22 defines a flat surface 24 in a plane perpendicular to the plane of the doorway. The lip 22 usually is about one inch wide, but this dimension may vary.

As best shown in FIG. 29, the primary doorway has one or more primary doors 26, at least one of which is slidably mounted so that when it is retracted a portion of the doorway is opened to form a primary opening. Typically, there are two primary doors, one fixed 28 and one sliding 30, which are mounted in parallel planes on tracks within the primary frame 14. In closed position, the sliding door 30 abuts a primary upright 36 and is opened by movement along an inside track 31 to a position parallel to the fixed door 28 which is permanently mounted on a parallel track 29. Sometimes, a third fixed primary door is provided so that the sliding door is centered between the two fixed doors. In any event, in most instances the primary doors 26 are solid and usually glass, so they may be transparent. Such doorways frequently are used for connecting the inside of the living area of a dwelling an outdoor recreational area, such as a patio. Thus, the secondary door assembly 10 of the present invention is particularly suitable for providing a swinging screen door for sliding glass doors. However, the present invention is not limited to this application.

Referring now to FIG. 1, the secondary door assembly 10 of the present invention comprises a secondary frame 32 which preferably is constructed of a lightweight, rigid, inexpensive and weather resistance material, such as aluminum. The secondary frame 32 is receivable within the primary frame 14, and preferably within the lip portion 22 thereof.

The secondary frame 32 preferably is formed by connecting a secondary header 34 and two secondary uprights 36 and 37, to form an inverted U-shaped structure which defines a secondary doorway. In the preferred embodiment, the secondary doorway will be about the same size as the primary opening.

Figure 16:
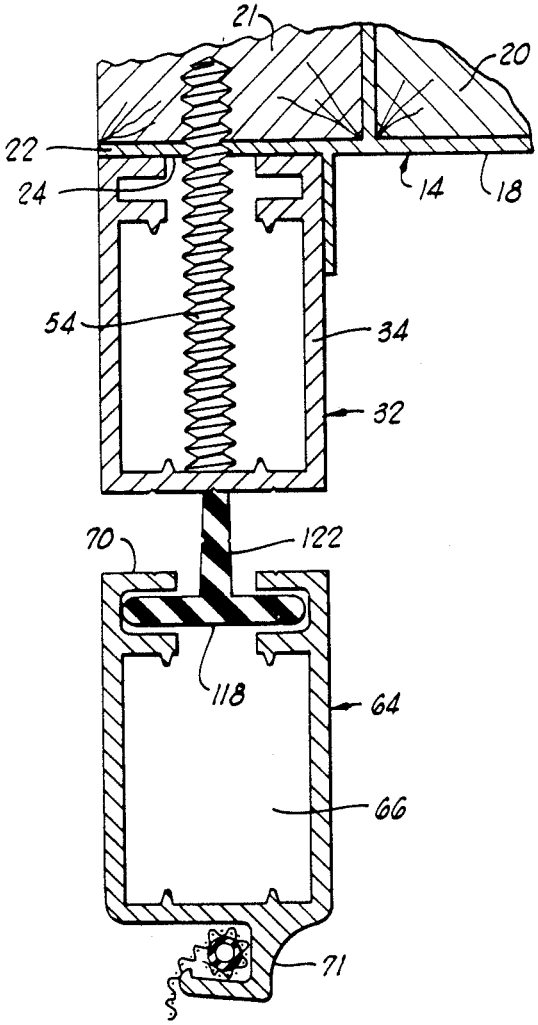
FIG. 16 is a cross-sectional view taken along line 16 of FIG. 1 showing contact between the edge of the flap seal of FIG. 10 for contacting the secondary header of the secondary frame. This view also shows the secondary header received within the lip of the primary header of the primary frame.
Figure 18:
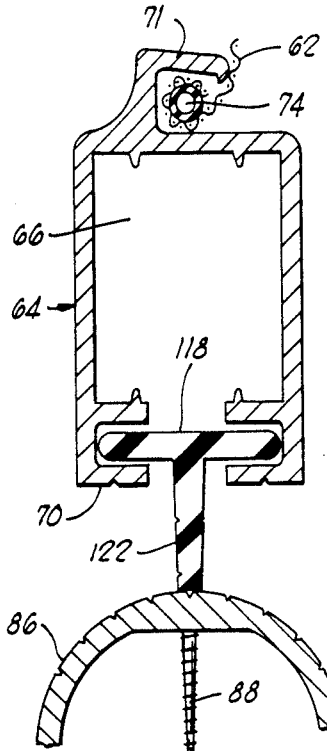
FIG. 18 is a cross-sectional view taken along line 18 of FIG. 1 showing contact of the flap seal shown in FIG. 10 with the secondary threshold.
Figure 17:
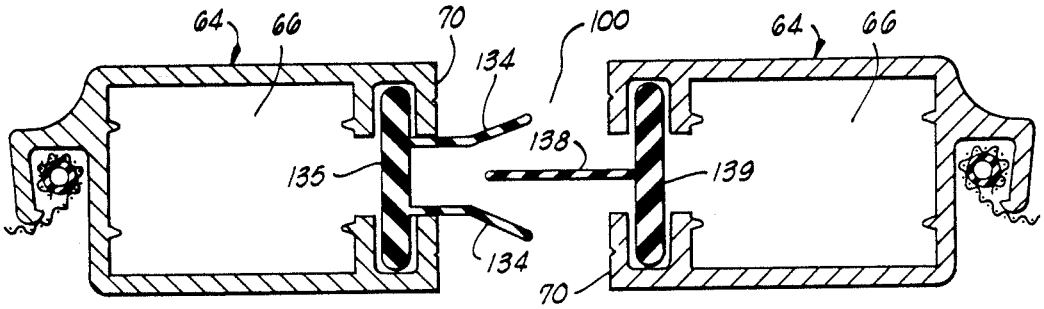
FIG. 17 is a cross-sectional view taken along line 17 of FIG. 1 showing the interlocking engagement between the channeled seal along the inner vertical edge of one screened panel and the flanged seal on the inner vertical edge of the other screened panel.

The secondary header 34 is adapted to be positioned along the primary header 18, and preferably within the lip portion 22 of the primary header 18 as best shown in FIG. 16. In this position, the lower ends of the secondary uprights 36 and 37 will approach the primary threshold 19. Thus, the secondary doorway may be aligned with the primary opening.

As indicated above, in many doorways with slidably mounted doors, the sliding door in closed position abuts an upright of the frame, as shown in FIGS. 1 and 29. In these doorways, one of the uprights 36 of the secondary door assembly 10 of this invention will be positioned along the same primary upright 16 as the closed sliding door 30 abuts, and the other secondary upright 37 will be free standing within the primary frame 14. However, it has been noted that some sliding doorways comprise three primary doors wherein the sliding door is centered between two fixed doors. In these cases, the secondary frame will be positioned so that both the secondary uprights are free standing with the frame. It will be seen that the secondary uprights 36 and 37 of the secondary door assembly 10 of this invention are adapted to be receivable adjacent a primary upright and for free standing within the primary frame so that the same assembly can be used in any of the above sliding glass door arrangements.

Figure 3:
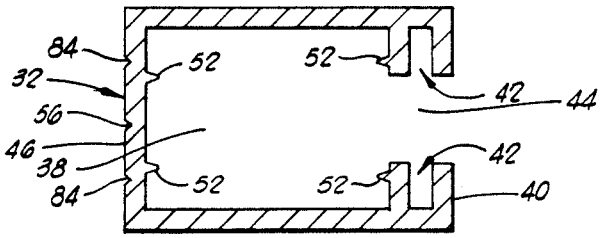
FIG. 3 is a cross-sectional view of the secondary frame on which the secondary door is mounted.
Figure 15:
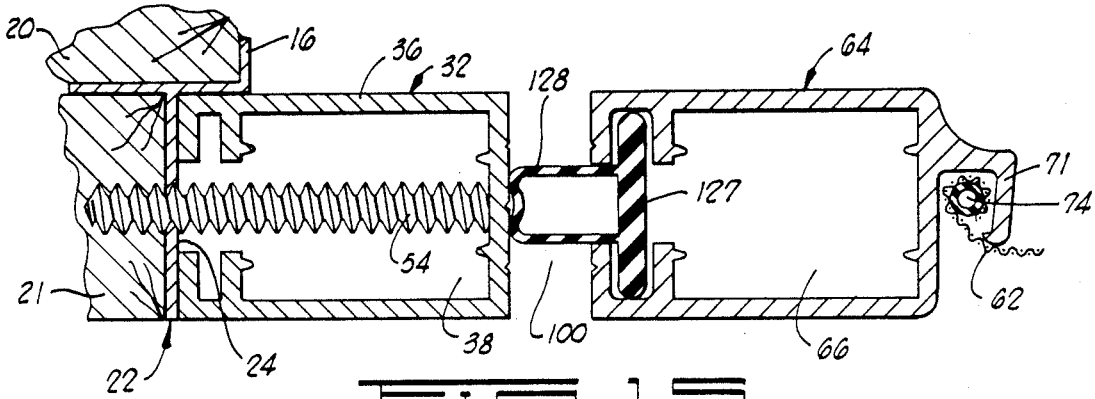
FIG. 15 is a cross-sectional view taken along line 15 of FIG. 1 showing the ridge seal of FIG. 12 slightly compressed against the adjacent secondary upright. The secondary frame is positioned in the lip portion on the outside of the primary frame.

With reference to FIGS. 3, 15 and 16, the secondary frame 32 preferably is receivable within the lip 22 along the header 18 and uprights 16 of the primary frame 14. To this end, the secondary frame 32 is angular, and preferably rectangular in cross section. The secondary frame 32 preferably has a hollow center 38 and one open side 40 which corresponds in shape to the flat surface 24 of the lip 22. The open side 40 of the secondary frame 32 preferably is provided with a pair of opposing interior grooves 42 which together define a channel 44 running longitudinally inside and communicating with the open side 40 of the secondary frame 32. The side 46 of the secondary frame 32 opposite the open side 40 is closed and forms a surface which will be adjacent the edges of the secondary door when the secondary door is closed.

The configuration of the open side 40 of the secondary frame 32 has several adavantages. For example, it reduces by one the layers of material involved when securing the secondary frame 32 to the primary frame 14, which reduces the effort required for installation of the assembly. Also, this feature reduces the weight of the assembly. A further advantage of the open side 40 and the channel 44 relates to attachment of a side seal which is described below.

Figure 4:
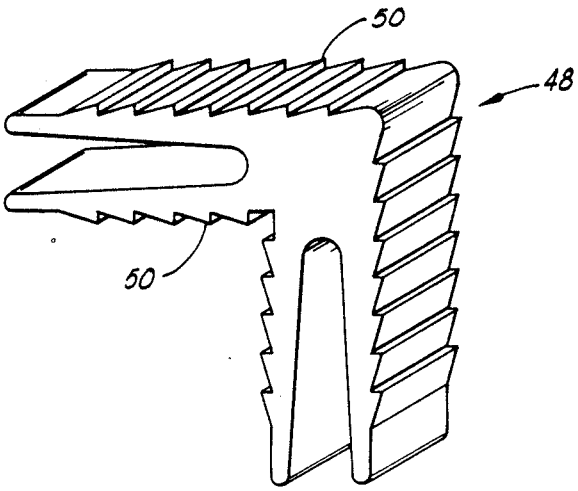
FIG. 4 is a perspective view of the corner key used to connect the longitudinal and vertical members of the secondary frame and of the secondary door.

As indicated above, the secondary header 34 and the secondary uprights 36 and 37 are connected to form the secondary frame 32. This connection may be carried out by any suitable method. A preferred method is the use of a corner key 48, shown in FIG. 4. The corner key 48 preferably is a piece of angled metal having cross ridges 50 on the outer and inner aspects of the angle. As shown in FIG. 3, the interior surface of the secondary frame 32 may be provided with two pairs of opposing longitudinal ridges 52. Thus, when the ends of the corner key 48 are inserted into mitered ends of the secondary header 34 and the secondary uprights 36 and 37, there will result a frictional engagement between the longitudinal ridges 52 inside the secondary frame 32 and the cross ridges 50 of the corner key 48. Further, where a softer metal, such as aluminum, is used to construct these elements, it is possible to jam the corner key 48 into the secondary frame 32 so that the longitudinal ridges 52 dig into the cross ridges 50 to form a more secure connection therebetween.

The secondary door assembly 10 of the present invention also comprises fasteners, such as the screws 54, for securing the secondary frame 32 within the primary frame 14. To facilitate positioning and insertion of the screws 54, the closed side 46 of the secondary frame 32 is provided with a screw line 56 centered longitudinally. A plurality of screws then may be inserted at intervals along the guide line 56 to secure the secondary frame 32 to the primary frame 14.

Figure 24:
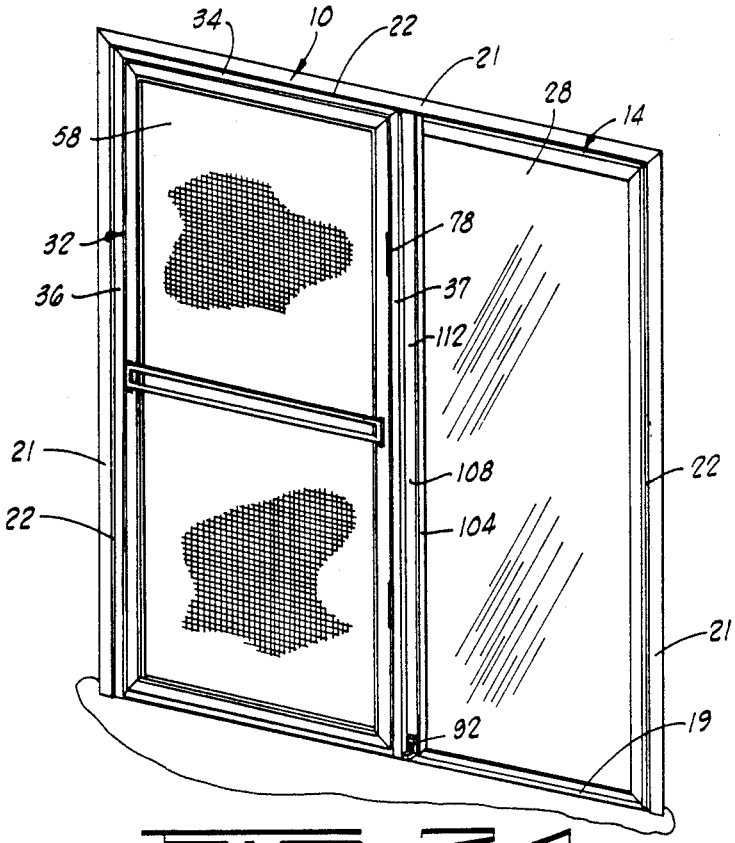
FIG. 24 is a perspective view of another embodiment of the secondary door assembly of the present invention in which the screen door comprises a single screened panel.
Figure 25:
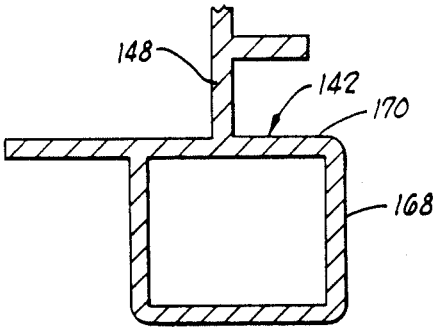
FIG. 25 is a cross-sectional view through an upright of the frame of the sliding glass door assembly of the present invention shown in FIG. 28.
Figure 26:
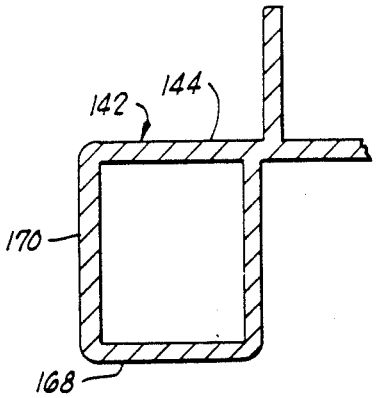
FIG. 26 is a cross-sectional view through the header of the frame of the sliding glass door assembly shown in FIG. 28.

As shown in FIGS. 1 and 24, the secondary door assembly 10 of the present invention also comprises a secondary door 58 which is receivable within the secondary frame 32. While the dimensions of the secondary door 58 are not critical, it is desirable for the secondary door 58 to be of a size which permits it to move freely through the primary opening and the secondary doorway so that the secondary door 58 can be mounted to swing inwardly and outwardly, as discussed below.

The secondary door 58 preferably is a screen door and more preferably comprises two screened panels 60, as shown in FIG.1. Suitable screened panels comprise a sheet of screen 62 mounted within a screen frame 64 so that the screen frame 64 forms the edges of the secondary door 58.

Figure 9:
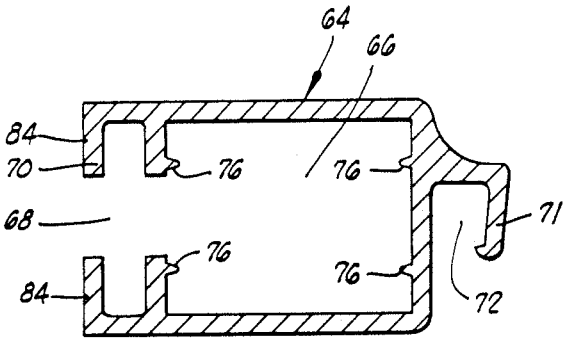
FIG. 9 is a cross-sectional view of the screen frame of the assembly shown in FIG. 1.

The screen frame 64 preferably is made of a material similar to that used for the secondary frame 32, such as aluminum. As shown in FIG. 9, the screen frame 64 preferably is shaped in cross section much like the secondary frame 32. The widths of the screen frame 64 and the secondary frame 32 preferably are about the same so that when assembled, the outside and inside surfaces of the secondary frame 32 and the secondary door 58 are substantially flush, as best shown in FIGS. 15 and 16.

Referring again to FIG. 9, the screen frame 64 has a hollow center 66 and a longitudinal channel 68 which communicates with an open side. Thus, in the preferred embodiment, the open side 70 of the screen frame 64 is identical to the open side 40 of the secondary frame 32. The purpose of the screen frame channel 68 relates to mounting of a side seal and is explained below.

For mounting the screen material 62, the screen frame 64 has a closed side 72 which defines a mounting groove 73 which is hook-shaped in cross section. The edges of the sheet of screen material 62 are rolled around a flexible cord 74 and crimped into the screen mounting groove 73 in a known manner, as is shown in FIGS. 15–18.

Referring again to FIG. 9, the screen frame 64 is provided with two pairs of opposing longitudinal ridges 76, like the longitudinal ridges 52 in the secondary frame 32. Thus, corner keys 48 of the same type as discussed above and as shown in FIG. 4 also may be used to connect mitered corners of the screen frame 64 in the manner set out above.

Figure 2:
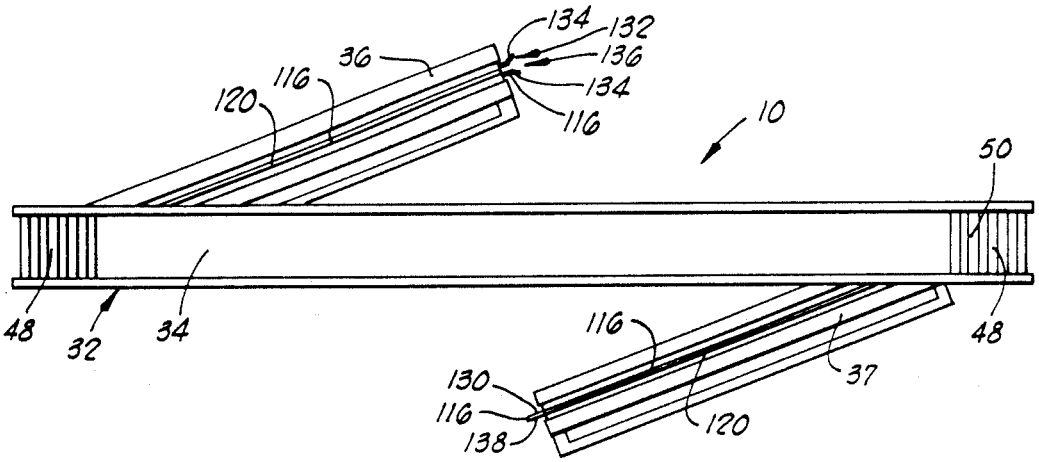
FIG. 2 is a top plan view of the secondary door assembly shown in FIG. 1 prior to installation in a doorway and showing the screened panels opening in opposite directions.
Figure 19:
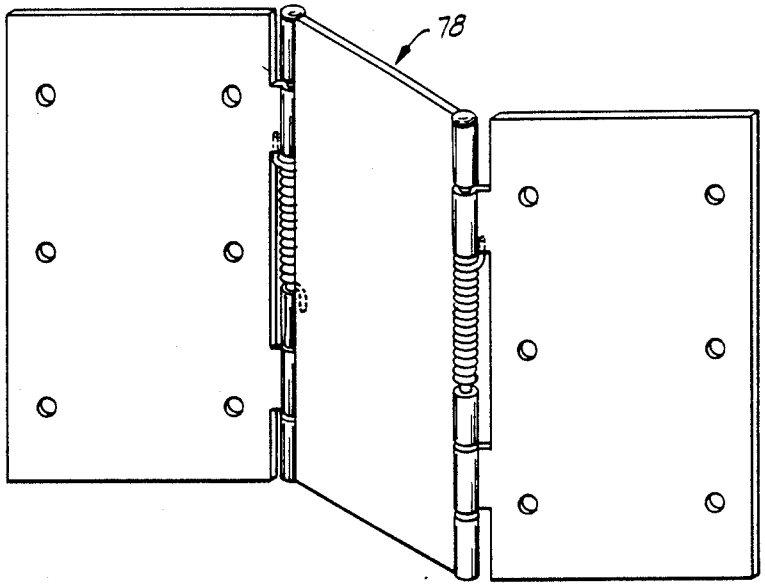
FIG. 19 is a perspective view of the assembled, unattached double action, spring loaded hinge of the assembly of the present invention.

When the secondary door 58 has been constructed, it then may be pivotally mounted within the secondary frame 32 in some suitable manner so that the secondary door 58 is supported for pivotation from a closed position parallel to the primary opening, as shown in FIGS. 1 and 29. Preferably, the secondary door 58 is mounted so as to be opened bi-directionally, that is, in an inward and an outward direction from the closed position. It is also desirable to provide a means by which the secondary door 58 will automatically return to the closed position. Further, where the secondary door 58 comprises a pair of panels 60 as shown in FIG. 1, the panels 60 preferably are independently mounted so that the panels 60 can swing in opposite directions, as shown in FIG. 2. For these reasons, a preferred mounting means is a plurality of double action spring loaded hinges 78 of the type shown in FIGS. 19 and 20. The hinges 78 may be attached by fasteners, such as screws 80, or rivets. The barrels of the hinge 78 may be offset so that when the secondary door 58 is in a closed position, the leaves of the hinge 78 will flatly fold and reduce the space occupied by the hinge 78. To facilitate positioning and insertion of the fasteners, the open side 70 of the screen frame 64 and the closed side 46 of the secondary frame 32 may be provided with longitudinal lateral guide lines 84 as shown in FIGS. 3 and 9.

The secondary door assembly 10 of the present invention also preferably comprises a secondary threshold 86, as shown in FIGS. 1, 7, 8 and 18, which is receivable within the primary frame 14. Preferably, the secondary threshold 86 is a curved strip of rigid material, such as aluminum, having longitudinal grooves 87. The strip then can be positioned over a portion of the primary threshold opposite the secondary header 34 of the secondary frame 32, and between the lower ends of the secondary uprights 36 and 37. Fasteners, such as screws 88, may be used for securing the secondary threshold 86 in position over the primary threshold 19.

It should be noted that the internal vertical dimensions, that is, the distance between the primary header 18 and the primary threshold 19 of commercially available sliding glass door frames is not standardized in the industry and may vary significantly between manufacturers. To accommodate pre-existing sliding doorways of varying vertical dimensions, the secondary door assembly 10 of the present inventiton further comprises extension bars 90 for adjusting the height of the secondary frame 32.

Figure 5:
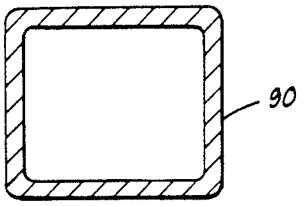
FIG. 5 is a cross-sectional view of the extension bar used to extend the length of the uprights of the secondary frame.
Figure 6:
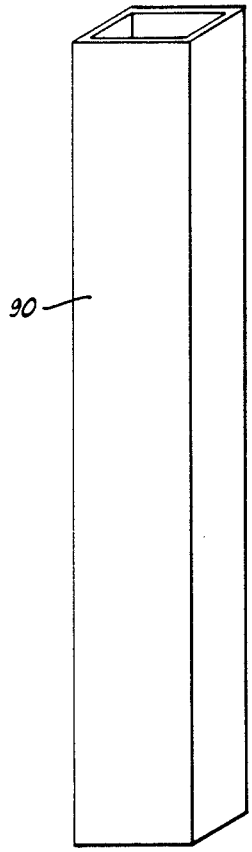
FIG. 6 is a perspective view of the extension bar shown in FIG. 5.
Figure 7:
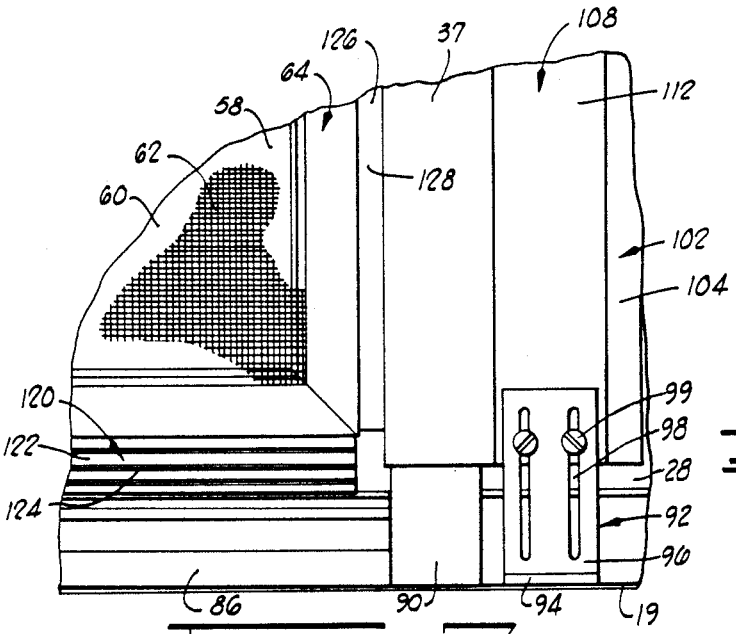
FIG. 7 is front elevational view of the inside lower portion of an installed secondary door assembly showing use of the extension bar shown in FIGS. 5 and 6. Also shown is the foot attached to the side seal connecting member for stabilizing the secondary frame on the free standing side.
Figure 8:
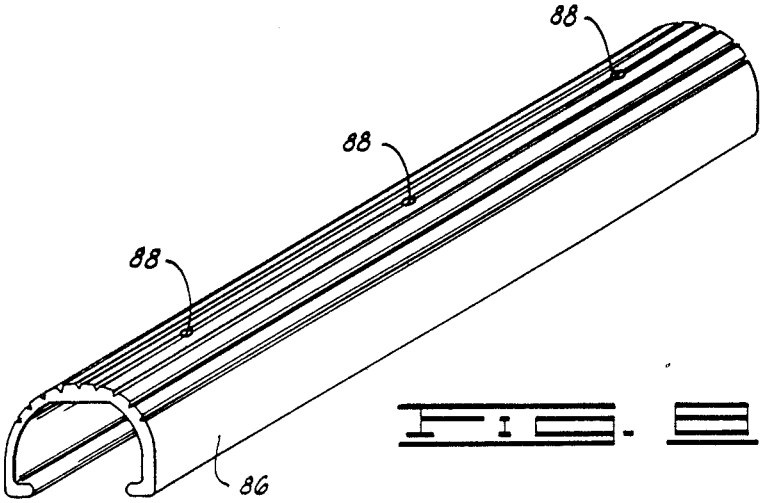
FIG. 8 is a perspective view of the threshold of the secondary door assembly.

As shown in FIGS. 5, 6 and 7, the extension bars 90 preferably are characterized by a shape and size which conforms to the shape and size of the secondary frame center 38 so that the extension bars 90 may be telescopically received therein. A preferred material for construction is aluminum. Thus, when the secondary header 34 is positioned along the primary header 18, the extension bars 90 may be extended a distance from the lower ends of the secondary uprights 36 and 37 to meet the primary threshold 19. It now can be seen that in those instances where extension bars 90 are utilized, the secondary threshold 86 preferably will be positioned therebetween to complete the secondary doorway.

Figure 23:
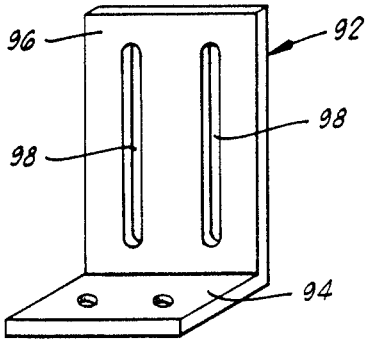
FIG. 23 is a perspective view of a foot, also shown in the installed assembly in FIG. 7.

As shown, in the installed secondary door assembly 10, one or both of the secondary uprights will be positioned free-standing in the primary frame, as is the secondary upright 37 in FIGS. 1 and 24. It is desirable to secure the lower end of the free standing secondary upright 37 in position in some suitable fashion. For example, an L-shaped metal foot 92 may be provided. Preferably, the base 94 of the foot 92 is secured to the primary threshold 19, and the back 96 of the foot is secured to the lower end of the side seal connecting member which is described below. Preferably, as shown in FIGS. 7 and 23, the foot 92 may be provided with slots 98 and fasteners, such as screws 99, so that the position of the foot 92 with respect to the secondary frame 32 is easily adjustable.

As described above, in the secondary door assembly 10 of this invention, the secondary door 58 preferably is adapted for swinging in both directions, which requires the secondary door 58 to be slightly smaller than the secondary doorway. This leaves a space 100 around the periphery of the secondary door 58. Also, as best shown in FIG. 29, there will usually be a space 101 between free standing secondary uprights 37 and the adjacent primary door 28. Insects and air-borne matter can enter the inside through these spaces when the sliding door 30 is open, even though the secondary door 58 is closed. For this reason, it is desirable to provide the secondary door assembly 10 with a system of gaskets or seals for providing a seal between the inside and the outside when the secondary door 58 is closed. Preferably, the seals of this assembly are made of flexible waterproof material, such as vinyl. Such strips may be manfactured in lengths and cut to fit assemblies of varying sizes.

A side seal 102, preferably is provided to form a seal in the space 101 between each free standing secondary upright 37 and the adjacent primary door which in the embodiment shown in FIGS. 1, 21, 22 and 29, is the fixed door 28. As shown in the Figures the side seal 102 preferably extends longitudinally from the free standing secondary upright 37.

Figure 11:
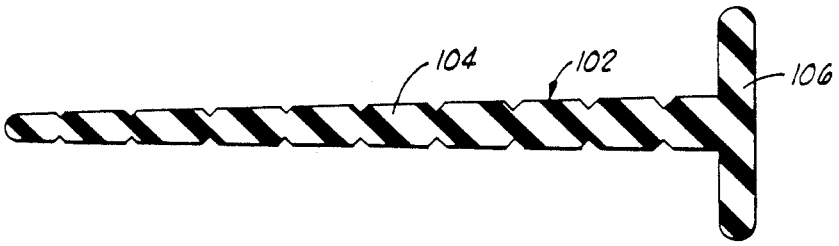
FIG. 11 is a cross-sectional view of the side seal of the assembly shown in FIG. 1.
Figure 22:
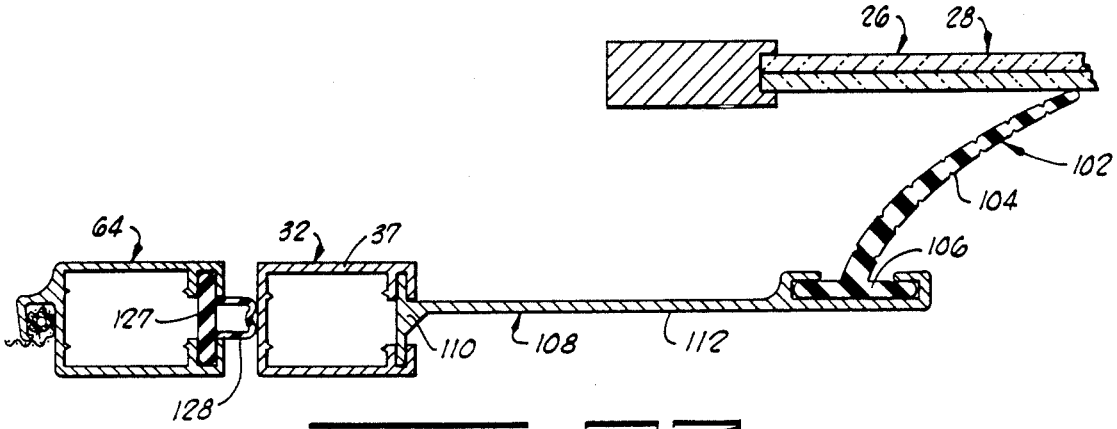
FIG. 22 is a cross-sectional view taken along line 22 of FIG. 1 showing the connecting member attached to the secondary frame and supporting the side seal in contact with the surface of a primary door.
Figure 21:
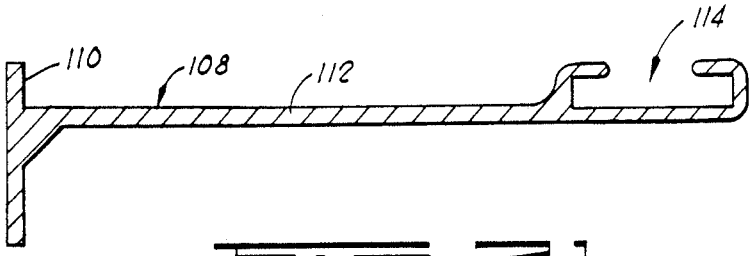
FIG. 21 is a cross-sectional view of the side seal connecting member of the assembly shown in FIG. 1.

Preferably, the side seal 102 is made of a strip of flexible material which is T-shaped in cross-section, having a flap 104 extending from a spine 106, as shown in FIG. 11. As shown in FIG. 22, the side seal 102 may be connected to the free-standing secondary upright 37 by means of a side seal connecting member 108, preferably made of a rigid material, such as aluminum. Referring now to FIG. 21, the connecting member 108 comprises a connector portion 110, a neck 112 and a side seal receiving slot 114. The slot 114 preferably has a shape which comforms to the shape of the side seal spine 106 so that the spine 106 may be threaded into the slot 114. Likewise, the connector portion 110 is shaped so as to conform to the secondary frame channel 44. Thus, a side seal connecting member 108 can be connected to each free standing upright 37 by slipping the connector portion 110 into the secondary frame channel 44.

The free standing side (or sides) of the installed secondary frame 32 then may be secured in position by attaching the foot 92 to the primary threshold 19 and the lower end of the connecting member 108, as indicated above and as shown in FIGS. 1 and 24. Also, as shown in FIG. 7, where the length of the secondary frame 32 has been extended by the extension bars 90, the slots 98 of the foot 92 allow the lenght of the connecting member 108 to be extended similarly. It can be seen that the foot 92 in this instance assists in sealing the space 101.

The system of seals the in secondary door assembly 10 also preferably will comprise flexible door seals which extend about the edges of the secondary door 58 for sealing the space 100 thereabout. Preferably, the door seals are each provided with a contactor portion extending from a spine. The shape of the contactor portion preferably will vary according to the position in the assembly. However, the spines are similarly shaped to be received within the screen frame channel 68 which extends around the edges of the secondary door 58.

Figure 10:
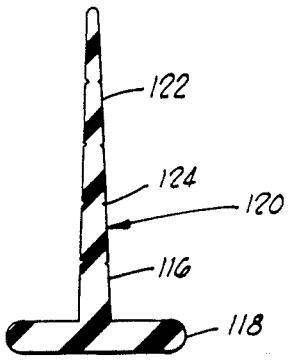
FIG. 10 is a cross-sectional view of an adjustable flap-type door seal of the assembly shown in FIG. 1.

For the upper and lower edges of the secondary door 58 a flap-type seal 120, shown in FIG. 10, may be provided. The flap seal has a flap 122 extending from the spine 123. The flap 122 is adapted to slightly brush against the secondary header 34 and the primary threshold 19, or the secondary threshold 86, whichever is used. The preferred flap seal is provided with cut lines 124 to facilitate trimming of the flap 122 to fit with the threshold. It should noted that where the secondary door 58 comprises a single panel, the flap seal 120 may also be used along the side of the secondary door which opens, as the flap 122 will brush against the adjacent surface of the closed side 46 of the secondary upright 36 as the secondary door 58 is pushed back and forth through the secondary doorway.

Figure 12:
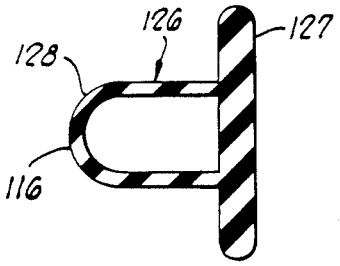
FIG. 12 is a cross-sectional view of the ridge seal of the assembly shown in FIG. 1.
Figure 13:
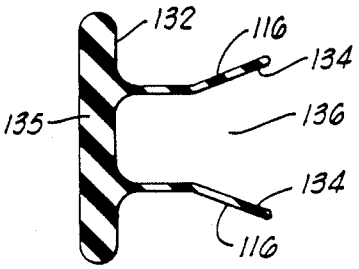
FIG. 13 is a cross-sectional view of the channeled seal of the assembly shown in FIG. 1.
Figure 14:
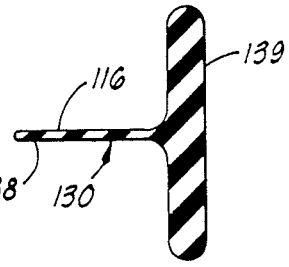
FIG. 14 is a cross-sectional view of the flanged seal of the assembly shown in FIG. 1.
Figure 20:
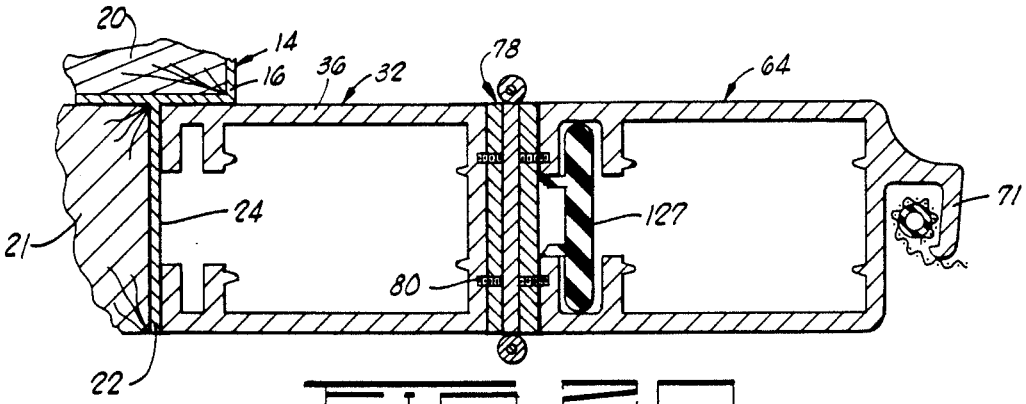
FIG. 20 is a cross-sectional view taken along line 20 of FIG. 1 showing the attachment of the leaves of the hinge shown in FIG. 19 to the side of the screen frame and the secondary upright. In this view the secondary door is closed and the hinge is collapsed.

The door seals also preferably include a ridge seal 126 in which the contactor portion is a rounded compressible ridge 128 extending from the spine 129, such as the seal shown in cross section in FIG. 12. The ridge seal 126 is suitable for use along the mounted sides of the secondary door 58. A seal is formed by slight compression of the ridge 128 against the closed side 46 of the adjacent secondary uprights 36 and 37. As shown in FIG. 20, the ridge of the seal 126 may be cut away to accommodate the leaf of the hinge 78.

Where the secondary door 58 comprises two panels 60, the door seals preferably include flexible interlocking seals disposed along the inner juxtaposed edges of the panels 60. The interlocking seals preferably comprise a flanged seal 130, shown in FIG. 14, and a channeled seal 132, shown in FIG. 13. The contactor portion of the channeled seal 132 comprises two spaced apart flaps 134 extending from a spine 135 to form a channel 136 for receiving the flange 138 of the flanged seal 130 having the spine 139 when the panels 60 are in closed position. Thus, the interlocking seals easily can engage and disengage as the panels are opened and closed, and operate as a passive latch.

From the foregoing, it is shown that in accordance with the present invention, a secondary door assembly 10 may be constructed to suit virtually every sliding door arrangement. For example, a secondary door assembly may be made to provide a single-paneled or double paneled secondary door, a right handed or left handed swinging door and a secondary door which swings in both directions. Now it will be described how each embodiment of the secondary door assembly of the present invention is easily installed in the primary doorway with only simple, household tools.

First, the desired position of the secondary frame 32 is selected. Then, to place the secondary door 58 over the primary opening, the side seals 102 are applied to each secondary upright 37 which will be free standing.

Next, the need for height adjustment is assessed by measuring the distance between the primary header 18 and the primary threshold 19. When this distance is about equal to the length of the secondary uprights 36 and 37, the extension bars 90 may be removed and discarded. Where the primary header-threshold distance is greater than the length of the secondary uprights 36 and 37, the extension bars 90 are left in place inside the lower ends of the secondary uprights 36 and 37. The extension bars 90 then are allowed to descend to meet the primary threshold 19 when the secondary door assembly 10 is positioned within the primary frame 14.

Next, the secondary door assembly 10 is positioned bodily within the lip portion 22 of the primary frame 14 in the selected position. Having thus positioned the secondary door assembly 10, the secondary frame 32 may be secured to the primary frame 14. It usually will be easier first to secure the secondary header 34 to the primary header 18. Then, the secondary uprights 36 and 37 may be secured in position, the free standing uprights 37 by the foot 92 connected to the side seal connecting member 108, and the upright 36 to the adjacent primary upright, all as described previously. It will be recalled where both secondary uprights are free standing, a pair of feet may be used, one for each upright. Where a secondary threshold 86 is to be used, it will preferably be positioned and secured before the feet 92 are secured. The flap-type door seals 120 then may be trimmed as needed to clear the secondary threshold 86.

As described above, the secondary frame 32 preferably is designed to fit in the lip portion 22 provided along the header and uprights of most commercially available sliding glass door frames. Where no such lip portion is provided, strips of angled metal (not shown) may be attached to provide such a lip for easy installation of this assembly.

Finally, the secondary door assembly 10 of the present invention readily accommodates accessories which are commercially available. Such accessories include handles, decorative kick plates, push bars, and a variety of latches and other security features.

Replacement Screen Door Kit

The secondary door assembly 10 easily may be provided as a replacement kit for installing a swinging screen door in place of a sliding screen door on existing sliding glass doorways. Preferably, such a kit would comprise a pre-assembled secondary door assembly wherein the secondary door is pre-assembled and mounted within the secondary frame. More preferably, the kit would include the above described seal system, including the door seals, and the side seals with side seals connecting members. Also, the preferred kit would include extension bars, a secondary threshold, a pair of feet and a plurality of fasteners for securing the secondary frame and the secondary threshold within the sliding glass door frame, all as described above. This kit could be installed easily and quickly using simple household tools, as described. After removing the original sliding screen door, the user would need only to attach side seals as necessary on the secondary uprights 36 and 37, then secure the secondary frame 32 in position, as described above, and trim the flap seals as needed. Kits would be provided for pre-assembled right-handed and left-handed single-paneled screen doors, as well as double-paneled screen doors.

Sliding Glass Door Assembly

Figure 28:
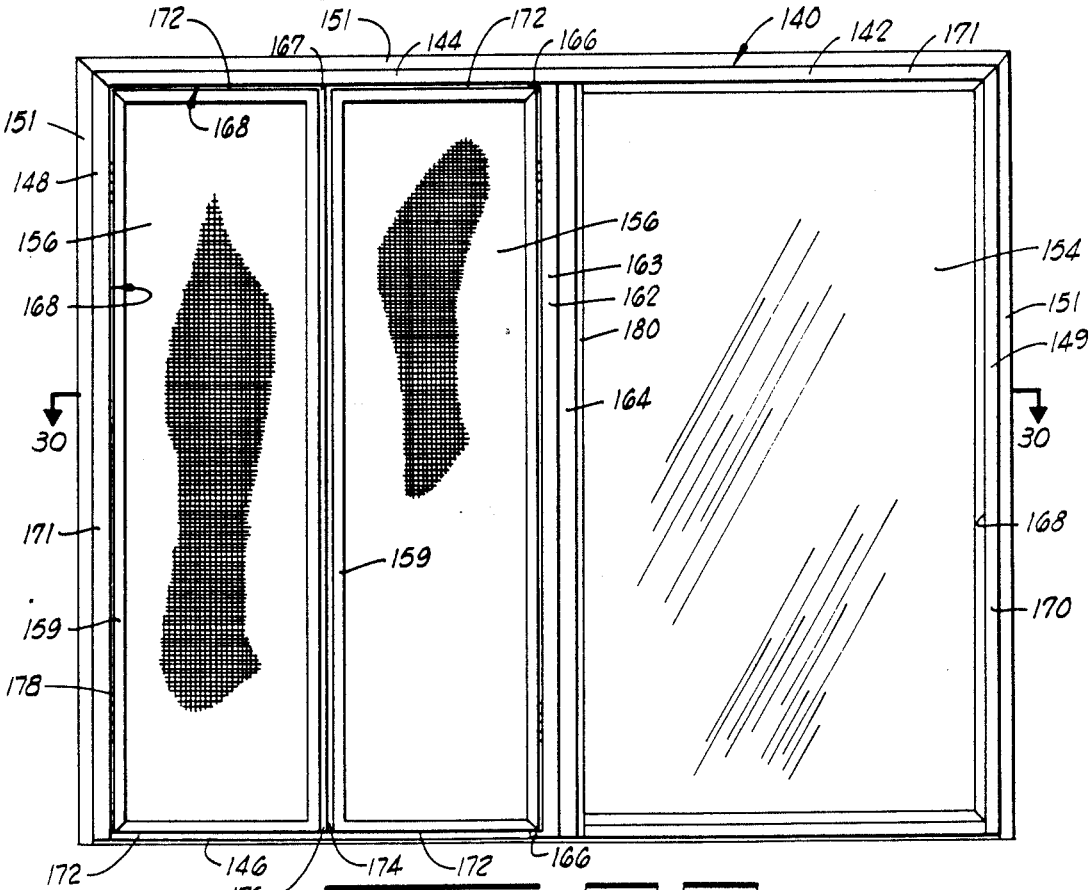
FIG. 28 is a front elevational view of one embodiment of the sliding glass door assembly of the present invention wherein the screen door comprises two panels.
Figure 2:
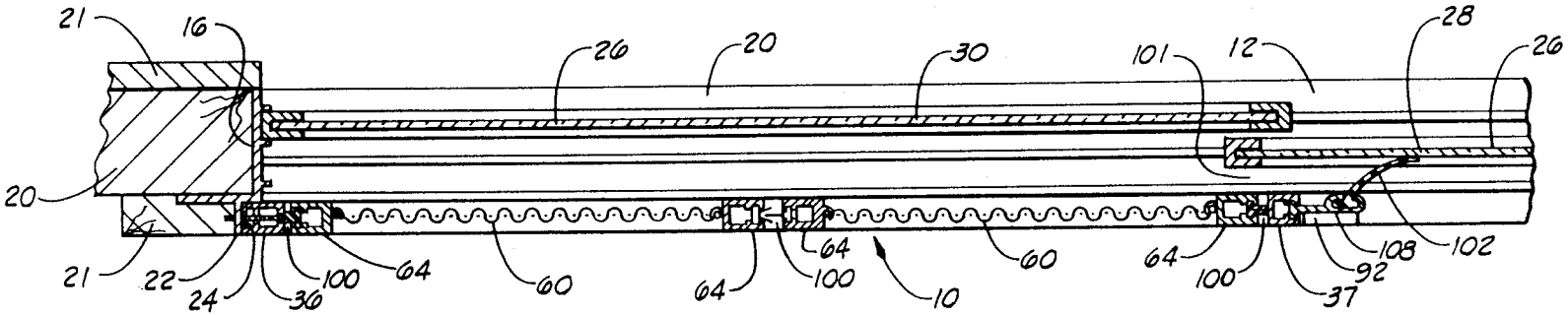
Figure 3:
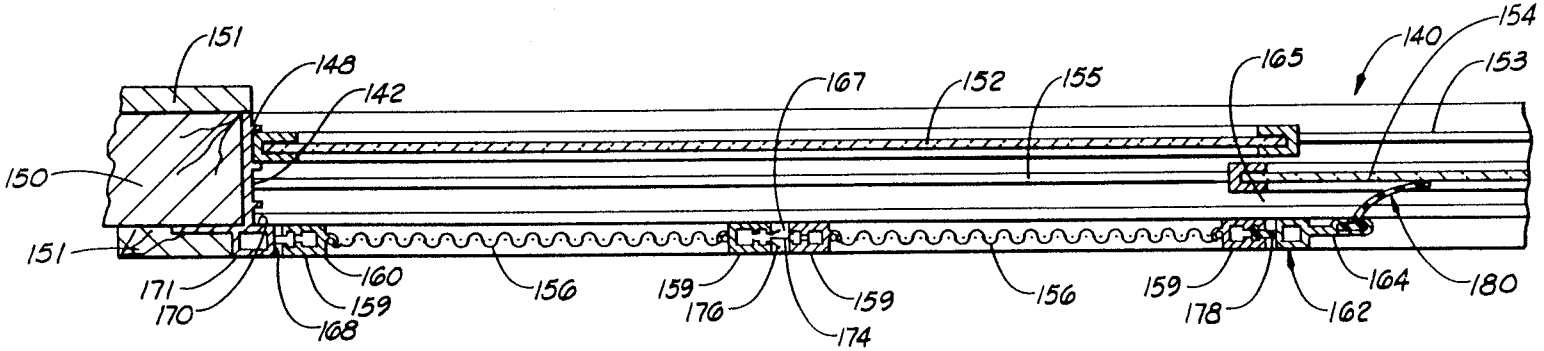

The present invention also comprises a sliding glass door assembly with a pivotally mounted screen door. A preferred embodiment of the sliding glass door assembly of the present invention is shown in FIGS. 28 and 30, designated generally by the reference numeral 140.

The sliding glass door assembly 140 first comprises a frame 142 receivable with the doorway, and having a header 144, a threshold 146 and two uprights 148 and 149. The frame 142 preferably is constructed of a sturdy, relatively heavy material, such as aluminum or steel. The frame 142 is adapted to be installed in a rough opening formed by studs 150 and provided with exterior and interior trim 151.

At least two solid doors 152 and 154 are mounted in parallel planes on tracks 153 and 155 within the frame 142. At least one of the solid doors 152 is slidably mounted so that upon retraction the doorway is at least partially opened to form a primary opening.

The sliding glass door assembly 140 further comprises a screen door 156 comprising at least one panel 158. The screen door 156 is supported within the frame 142 in a plane parallel with the solid doors 152 and 154. The screen door 156 is supported therein in a closed position aligned with the primary opening. The screen door 156 is constructed as previously described and has dimensions which permit it to move through the primary opening and the frame 142.

The assembly 140 also comprises fasteners, such as screws 160, for mounting the screen door 156 within the frame 142. The screen door 156 is mounted for pivotation in an inward and outward direction from the closed position. A suitable way of pivotally mounting the screen door 156 is the double action, spring loaded hinge 78, described above with respect to the secondary door assembly 10.

Figure 27:
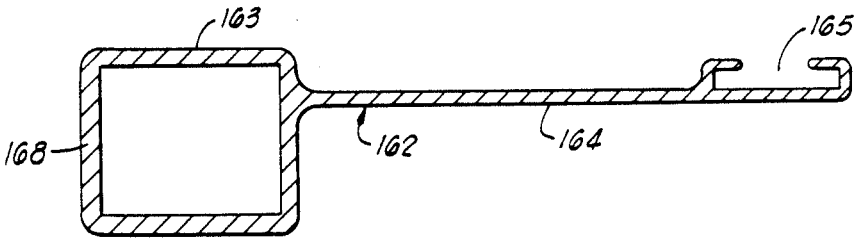
FIG. 27 is a cross-sectional view through a center post of the sliding glass door assembly shown in FIG. 28.

In most instances it will be preferred to have the screen door 156 mounted for pivotation about an axis which is parallel to and between the uprights 148 and 149 of the frame 142. One such instance is where a single-paneled screen door needs to open on a side which abuts the frame. Another such instance is where a screen door is positioned in the center of a three door sliding glass doorway. In these instances, the mounted side of the screen door 156 may be supported on a center post 162, as shown in FIGS. 27, 28 and 30. The center post 162 preferably is a single element which resembles the free standing secondary upright 37 its attached connecting member 108, described above in relation to the secondary door assembly 10. Thus, the center post comprises a center 163 and a neck portion 164 having a seal receiving space 165 formed in the edge thereof. The center post 162 may be secured within the frame 142 in any suitable manner, such as by a pair of feet 166, best shown in FIG. 28.

In order for the screen door 156 to swing freely in both directions through the frame 142, the screen door 156 will be smaller than the primary opening. When the smaller screen door 156 is aligned with the larger primary opening, there will be a space 167 around the screen door 156. Thus, in order to effect the mounting of the screen door and the system of door seals, it will be desirable to provide the frame 142 with a mounting surface 168. Preferably, the mounting surface 168 extends about the primary opening and is perpendicular thereto. The mounting surface 168 preferably defines an opening only slightly larger than the screen door 156 to minimize the space 167. Thus, the screen door 156 then may be mounted by hinges 78, as described above, on the mounting surface 168, as shown in FIG. 30. A suitable mounting surface 168 may be provided by forming an angular projection 170 around the outside of the frame 142. As best shown in FIGS. 29 and 30, the angular projection 170 is oriented with respect to the frame 142 and the screen door 156 much like the secondary frame 32 is oriented to the lip 22 and the secondary door 58 of the secondary door assembly 10, previously described.

As indicated above, the sliding glass door assembly 140 preferably also comprises a seal system for providing a seal between the inside and the outside, similar to the seal system of the secondary door assembly 10 described above. Accordingly, the door seals preferably include a flap seal 172 similar to the flap seal 120, interlocking flanged seal 174 channeled seal 176 similar to the flanged and channeled seals 130 and 132, and a ridge seal 178 similar to the ridge seal 126. A side seal 180 similar to the side seal 102 also is preferably included and is connectable in a similar manner to the seal receiving space 165 of the center post 162. It will noted that where a mounting surface 168 is provided, the mounting surface 168 will be the contact surface for the door seals as is the closed side 72 of the secondary assembly 10 above.

From the foregoing, it will be appreciated that the present invention provides sliding doorways with an adjustable, bi-directionally swinging secondary door. In the preferred embodiment, a swinging screen door is provided for sliding glass "patio" doors which totally avoids the problems of sticking and derailing so common in conventional sliding screen doors.

Changes may be in construction, operation and arrangement of the various parts, elements, steps and procedures described herein without departing from the spirit and scope of the invention as defined in the following claims.

What is claimed is:

1. A secondary door assembly for a primary doorway which connects an inside and an outside and which is defined by a primary frame having two primary uprights, a primary header and a primary threshold and which has at least one primary door which is slidably mounted within the primary frame so that when the sliding door is retracted a portion of the primary doorway is opened forming a primary opening, comprising:

a secondary frame receivable within the primary frame, the secondary frame having a secondary header and two secondary uprights, the secondary header being receivable within a portion of the primary header and each secondary upright being receivable adjacent a primary upright and also being adapted for free standing within the primary frame, and wherein the secondary frame defines a secondary doorway substantially coextensive with the primary opening of the primary doorway;

means for securing the secondary frame within the primary frame so that the secondary doorway is parallel to the plane of the primary opening;

a secondary door receivable within the secondary frame; and means for mounting the secondary door within the secondary frame so that the secondary door is supported for pivotation about a vertical axis from a closed position parallel to the primary opening.

2. The secondary door assembly of claim 1 in which the outside of the primary frame is characterized by a lip portion and in which the secondary frame is receivable within such lip portion.

3. The secondary door assembly of claim 2 in which the pivotal mounting means is characterized by supporting the secondary door for pivotation in an inward and outward direction from the closed position, in which the secondary door is characterized by dimensions which permit the secondary door to move through the primary opening, and in which the secondary frame is characterized by internal dimensions which permit the secondary door to move therethrough.

4. The secondary door assembly of claim 3 further comprising:

means for providing a seal between the inside and the outside when the secondary door is in closed position.

5. The secondary door assembly of claim 4 which the seal means comprises:

door seals extending around the edges of the secondary door.

6. The secondary door assembly of claim 5 in which at least one of the secondary uprights is disposed in a free standing position within the primary frame and in which the seal means further comprises:

side seals extending longitudinally between each free standing secondary upright and a primary door.

7. The secondary door assembly of claims 5 or 6 in which the secondary door comprises first and second juxtaposed panels having inner vertical edges which are adjacent in the closed position, and in which the seal means further comprises:

interlocking seals comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

8. The secondary door assembly of claim 2 further comprising: means for adjusting the height of the secondary frame.

9. The secondary door assembly of claim 8 in which the pivotal mounting means is characterized by supporting the secondary door for pivotation in an inward and outward direction from the closed position, in which the secondary door is characterized by dimensions which permit the secondary door to move through the primary opening, and in which the secondary frame is characterized by internal dimensions which permit the secondary door to move therethrough.

10. The secondary door assembly of claim 9 further comprising:

means for providing a seal between the inside and the outside when the secondary door is in closed position.

11. The secondary door assembly of claim 10 in which the seal means comprises:

a door seal extending around the edge of the secondary door.

12. The secondary door assembly of claim 11 in which at least one of the secondary uprights is disposed in a free standing position within the primary frame and in which the seal means further comprises:

a side seal extending longitudinallly between each free standing secondary upright and a primary door.

13. The secondary door assembly of claims 11 or 12 in which the secondary door comprises first and second juxtaposed panels having inner vertical edges which are adjacent in the closed position, and in which the seal means further comprises:

an interlocking seal assembly comprising:

a flanged seal disposed along the inner vertical edge of the first panel wherein the flange extends toward the inner vertical edge of the seond panel when the panels are in closed position; and a channeled seal extending along the inner vertical edge of the second panel adapted for receiving the flanged seal when the panels are in closed position.

14. The secondary door assembly of claim 1 in which the pivotal mounting means is characterized by supporting the secondary door for pivotation in an inward and outward direction from the closed position, in which the secondary door is characterized by dimensions which permit the secondary door to move through the primary opening, and in which the secondary frame is characterized by internal dimensions which permit the secondary door to move therethrough.

15. The secondary door assembly of claim 14 further comprising:

means for providing a seal between the inside and the outside when the secondary door is in closed position.

16. The secondary door assembly of claim 15 in which the seal means comprises:

a door seal extending around the edge of the secondary door.

17. The secondary door assembly of claim 16 in which at least one of the secondary uprights is disposed in a free standing position within the primary frame and in which the seal means further comprises:

a side seal extending longitudinally between each free standing secondary upright and a primary door.

18. The secondary door assembly of claims 16 or 17 in which the secondary door comprises first and second juxtaposed panels having inner vertical edges which are adjacent in the closed position, and in which the seal means further comprises:

an interlocking seal assembly comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

19. The secondary door assembly of claim 14 further comprising:

means for adjusting the height of the secondary frame.

20. The secondary door assembly of claim further comprising:

means for providing a seal between the inside and the outside when the secondary door is in closed position.

21. The secondary door assembly of claim 20 in which the seal means comprises:

a door seal extending around the edge of the secondary door.

22. The secondary door assembly of claim 21 in which at least one of the secondary uprights is disposed in a free standing position within the primary frame and in which the seal means further comprises:

a side extending longitudinally between each free standing secondary upright and a primary door.

23. The secondary door assembly of claims 21 or 22 in which the secondary door comprises first and second juxtaposed panels having inner vertical edges which are adjacent in the closed position, and in which the seal means further comprises:

an interlocking seal assembly comprising: a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

24. The secondary door assembly of claim 1 further comprising:

means for adjusting the height of the secondary frame.

25. The secondary door assembly of claim 24 in which the height adjusting means is characterized by extending the length of the secondary uprights.

26. A screen door replacement kit for a sliding glass doorway which connects an inside and an outside which comprises a primary frame having two uprights, a primary header and a primary threshold, and at least two glass doors which are mounted on parallel planes within the primary frame at Least one of such glass doors being slidably mounted so that when the sliding glass door is retracted, a portion of the primary doorway is opened to form a primary opening, wherein the kit comprises:

a secondary frame receivable within the primary frame, the secondary frame having a secondary header and two secondary uprights, the secondary header being receivable within a portion of the primary header and each secondary upright being receivable adjacent a primary upright and also being adapted for free standing within the primary frame, and wherein the secondary frame defines a secondary doorway substantially coextensive with the primary opening of the primary doorway;

means for securing the secondary frame within the primary frame so that the secondary doorway is parallel to the plane of the primary opening;

a screen door receivable within the secondary frame; and means for mounting the screen door within the secondary frame so that the screen door is supported for pivotation about a vertical axis from a closed position being parallel to the primary opening.

27. The kit of claim 26 in which the outside of the primary frame is characterized by a lip portion and in which the secondary frame is receivable within the lip portion.

28. The kit of claim 27 in which the pivotal mounting means is characterized by supporting the screen door for pivotation in an inward and outward direction from the closed position, in which the screen door is characterized by dimensions which permit the screen door to move through the primary opening, and in which the screen door frame is characterized by internal dimensions which permit the screen door to move therethrough.

29. The kit of claim 28 further comprising:

means for providing a seal between the inside and the outside when the screen door is in closed position.

30. The kit of claim 29 in which at least one of the secondary uprights is disposed in a free standing position within the primary frame and in which the seal means comprises:

a door seal extending around the edge of the screen door; and a side seal extending longitidunally between each free standing secondary upright and a primary door.

31. The kit of claim 30 in which the screen door comprises first and second juxtaposed panels having inner vertical edges which are adjacent in the closed position, and in which the seal means further comprises:

an interlocking seal assembly comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

32. The kit of claim 27 further comprising:

means for adjusting the height of the secondary frame.

33. The kit claim 32 in which the pivotal mounting means is characterized by supporting the screen door for pivotation in an inward and outward direction from the closed position, in which the screen door is characterized by dimensions which permit the screen door to move through the primary opening, and in which the screen door frame is characterized by internal dimensions which permit the screen door to move therethrough.

34. The kit of claim 33 further comprising:

means for providing a seal between the inside and the outside when the screen door is in closed position.

35. The kit of claim 34 in which at least one of the secondary uprights is disposed in a free standing position within the primary frame and in which the seal means comprises:

a door seal extending around the edge of the screen door; and a side seal extending longitudinally between each free standing secondary upright and a primary door.

36. The kit of claim 35 in which the screen door comprises first and second juxtaposed panels having inner vertical edges which are adjacent in the closed position, and in which the seal means further comprises:

an interlocking seal assembly comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

37. The kit claim 26 in which the pivotal mounting means is characterized by supporting the screen door for pivotation in an inward and outward direction from the closed position, in which the screen door is characterized by dimensions which permit the screen door to move through the primary opening, and in which the screen door frame is characterized by internal dimensions which permit the screen door to move therethrough.

38. The kit of claim 37 further comprising:

means for providing a seal between the inside and the outside when the screen door is in closed position.

39. The kit of claim 38 in which at least one of the secondary uprights is disposed in a free standing position within the primary frame and in which the seal means comprises:

a door seal extending around the edge of the screen door; and a side seal extending longitudinally between each free standing secondary upright and a primary door.

40. The kit of claim 39 in which the screen door comprises first and second juxtaposed panels having inner vertical edges which are adjacent in the closed position, and in which the seal means further comprises:

an interlocking seal assembly comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

41. The kit of claim 37 further comprising:

means for adjusting the height of the secondary frame.

42. The kit of claim 41 further comprising:

means for providing a seal between the inside and the outside when the screen door is in closed position.

43. The kit of claim 42 in which at least one of the secondary uprights is disposed in a free standing position within the primary frame and in which the seal means comprises:

a door seal extending around the edge of the screen door; and a side seal extending longitudinally between each free standing secondary upright and a primary door.

44. The kit of claim 43 in which the screen door comprises first and second juxtaposed panels having inner vertical edges which are adjacent in the closed position, and in which the seal means further comprises:

an interlocking seal assembly comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

45. The kit of claim 26 further comprising: means for adjusting the height of the secondary frame.

46. A sliding glass door assembly for a doorway connecting an inside and an outside, comprising:

a frame receivable within the doorway, the frame comprising a header, a threshold and two uprights;

at least two solid doors mounted on parallel planes within the frame, at least one of the solid doors being slidably mounted so that upon retraction the doorway is partially opened to form a primary opening;

a screen door comprising at least one panel supported within the frame in a closed position parallel to the primary opening and having dimensions which are substantially coextensive with the primary opening and which permit the screen door to move through and primary opening;

means for mounting the screen door for pivotation about a vertical axis for movement in an inward and an outward direction from the closed position; and means for providing a seal between the inside and outside when the screen door is in a closed position.

47. The sliding glass door assembly of claim 46 further comprising:

at least one center post positioned within the frame parallel to the uprights and against one side of the screen door when the screen door is in closed position; and in which the seal means comprises: a side seal extending longitudinally along each center post between the center post and the solid doors.

48. The sliding glass door assembly of claims 46 or 47 in which the seal means comprises:

a door seal extending around the edges of the screen door.

49. The sliding glass door assembly of claim 47 in which the screen door is characterized by first and second juxtaposed panels having inner unmounted vertical edges which are adjacent each other when the panels are in closed position, and at least one of such panels being mounted for pivotation about the axis of a center post, and in which the seal means comprises:

a door seal extending around the edges of the screen door;

a side seal extending longitudinally along each center post between the center post and the solid doors;

an interlocking seal assembly comprising:

a flanged seal disposed along the inner vertical edge of the first panel wherein the flange extends toward the inner vertical edge of the second panel when the panels are in closed position; and a channeled seal extending along the inner vertical edge of the second panel adapted for receiving the flanged seal when the panels are in closed position.

* * * * *

UNITED STATES PATENT AND TRADEMARK OFFICE

CERTIFICATE OF CORRECTION

PATENT NO. : 4,838,332

DATED : June 13, 1989

INVENTOR(S) : Patrick L. Mlenek

It is certified that error appears in the above—identified patent and that said Letters Patent is hereby corrected as shown below:

Col. 1, line 7, immediately following the words "SCREEN DOOR", please insert the words -- now abandoned.

Col. 2, lines 8 and 9, please delete the word "support" and substitute therefor the word -- supported --.

Col. 2, line 9, immediately following the word "position", please insert the word -- parallel --.

Col. 3, line 61, please delete the word "parellel" and substitute therefor the word -- parallel --.

Col. 4, line 65, immediately following the word "dwelling", please insert the word -- with --.

Col. 6, line 54, immediately following the word "side", please insert the numeral -- 70 --.

Col. 7, line 50, please delete the word "inventiton" and substitute therefor the word -- invention --.

UNITED STATES PATENT AND TRADEMARK OFFICE

CERTIFICATE OF CORRECTION

PATENT NO. : 4,838,332

DATED : June 13, 1989

INVENTOR(S) : Patrick L. Mlenek

It is certified that error appears in the above—identified patent and that said Letters Patent is hereby corrected as shown below:

Col. 8, line 35, immediately following the word "Figures", please insert the punctuation -- , --.

Col. 8, line 63, please delete the word "lenght" and substitute therefor the word -- length --.

Col. 11, line 42, following the numeral "37", please insert the word -- with --.

Col. 12, line 11, following the numeral "174", please insert the word -- and --.

Col. 14, line 3, please delete the word "seond" and substitute therefor -- second --.

Col. 15, line 23, please delete the word "Least" and substitute therefor -- least --.

Col. 16, line 53, immediately following the word "kit", please insert the word -- of --.

UNITED STATES PATENT AND TRADEMARK OFFICE

CERTIFICATE OF CORRECTION

PATENT NO. :4,838,332

DATED :June 13, 1989

INVENTOR(S) :Patrick L. Mlenek

It is certified that error appears in the above-identified patent and that said Letters Patent is hereby corrected as shown below:

Col. 18, line 11, please delete the word "and" and substitute therefor the word --the--.

Signed and Sealed this

Eighth Day of May, 1990

*Attest:*

HARRY F. MANBECK, JR.

*Attesting Officer*

*Commissioner of Patents and Trademarks*